US005289666A

United States Patent [19]

Hamilton

[11] Patent Number: 5,289,666

[45] Date of Patent: Mar. 1, 1994

[54] APPARATUS FOR APPLYING LABEL TAGS

[75] Inventor: Thomas W. Hamilton, Stoke Poges, United Kingdom

[73] Assignee: T. W. Hamilton Design Ltd., Burnham, United Kingdom

[21] Appl. No.: 841,858

[22] Filed: Mar. 20, 1986

[51] Int. Cl.[5] ..... B65B 5/04; B65B 35/20

[52] U.S. Cl. ..... 53/252; 221/39; 221/236; 271/135

[58] Field of Search ..... 53/252; 221/39, 236; 271/135; 227/118; 47/1 A

[56] References Cited

U.S. PATENT DOCUMENTS

| | | | |
|---|---|---|---|
| 1,032,556 | 7/1912 | Long | 271/135 |
| 1,418,117 | 5/1922 | Widell | 271/135 |
| 2,310,072 | 2/1943 | Fry | 221/39 X |
| 2,788,156 | 4/1957 | Cruzan | 221/236 |
| 4,020,881 | 5/1977 | Nothen | 47/1 A |

FOREIGN PATENT DOCUMENTS

| | | | |
|---|---|---|---|
| 504521 | 7/1930 | Fed. Rep. of Germany | 271/135 |
| 1119753 | 6/1956 | France | 271/236 |

*Primary Examiner*—John Sipos

*Attorney, Agent, or Firm*—Christie, Parker & Hale

[57] ABSTRACT

A tagging machine acts to automatically insert label tags into selected compartments of a seed tray as the tray passes under the machine.

A cartridge loaded with tags feeds the tags one by one to a breach channel. A pair of extractor fingers lift the tag in the breach channel, onto a deflector which deflects the emerging end of the tag between a pair of displacement fingers. Once the displacment fingers have received the tag they drive the tag back along the channel in the opposite direction to discharge the tag into the seed tray.

As the tag is moved in a direction to be discharged from the channel it displaces the extractor fingers out of the channel. The fingers are only brought back into the channel to lift the next tag, when the displacement fingers return to their tag receiving position.

10 Claims, 3 Drawing Sheets

APPARATUS FOR APPLYING LABEL TAGS

BACKGROUND OF THE INVENTION

1. Field of the Invention

The present invention relates to apparatus for applying label tags for example to trays of seeds or seedlings.

2. Description of Prior Art

Tags carrying seed or plant identifications have long been used in the horticultural industry. Such tags comprise a flat elongate member with a pointed lower end to facilitate insertion into the soil. When inserted into the soil the upper end of the tag stands proud of the soil and carries plant or seed identifying designations, for example, a picture of a flower or its name or both.

Trays of seeds or seedlings need to be marked with such tags to identify the product being sold. To data such tags have been inserted by hand and this is a labour intensive process. With the advent of tags of plastics material, the tags have become thinner and handling has become more difficult. A number of attempts have been made to manufacture apparatus which will automatically insert tags into trays, but because of the difficulty in handling the tags, none of the attempts have to date met with commercial success.

It is an object of the invention to provide an automatic tag inserting machine.

SUMMARY OF THE INVENTION

According to the present invention there is provided apparatus for applying label tags each said tag having a stepped portion, said apparatus comprising a dispensing head defining a breach channel for receiving the leading tag of a row of tags, a cartridge for housing a row of tags, means coupling the cartridge to the dispensing head to direct the row of tags towards the breach channel, a tag extraction assembly having tag engaging means movable into the channel into engagement with the stepped portion of the leading tag to displace the leading tag along said channel in one direction, a displacement member for receiving the leading tag and operable to displace the tag along the said channel in the opposite direction, guide means for guiding the leading end of the tag when displaced by the tag extraction assembly into engagement with the displacement member.

According to the present invention there is further provided a tagging machine comprising, means defining a rectilinear dispensing channel, means supporting a row of generally parallel extending tags, means for guiding said row of tags towards said dispensing channel, extraction means constrained for movement along an arcuate locus intersecting said dispensing channel to engage a said tag in said channel and displace it along said channel in one direction, deflection means located at one end of said channel to deflect an end portion of a said tag emerging from said channel in response to displacement by the extraction means, in a direction away from said row of tags, displacement means for receiving the deflected portion of said tag and displaceable along the channel in the opposite direction to dispense the tag from the other end of the channel and through displacement of the tag to displace the extraction means along its arcuate locus out of the channel.

According to the present invention there is yet further provided apparatus for applying label tags with stepped portions said apparatus comprising a dispensing head defining a dispensing channel along which label tags can be displaced longitudinally, means for feeding a supply of labels into said channel from a first direction substantially at right angles to the longitudinal axis of said channel, pivotally supported extraction means having a pair of extraction fingers movable along a locus which intersects the longitudinal axis of said channel and so allows the extraction fingers to engage the stepped portion of a said tag in said channel to displace the tag in second direction along the channel, guide means located at one end of said channel for deflecting the emerging end of the tag displaced by the extraction means in substantially the opposite direction to said first direction, a pair of displacement fingers for receiving the deflected end portion of the tag and displacing the tag along the channel in a third direction opposite to said second direction, displacement of said tag in the opposite direction displacing the extraction fingers out of the path of the channel to allow the tag to emerge unimpeded from said channel, displacement means for displacing said displacement fingers firstly in said third direction and secondly in said second direction, and coupling means for coupling the extraction means to said displacement fingers during the displacement of said displacement fingers in said second direction, to move the extraction fingers back into the channel to effect displacement of a fresh tag in the channel in said second direction.

BRIEF DESCRIPTION OF THE DRAWINGS

Apparatus for applying label tags and embodying the invention will now be described by way of example, with reference to the accompanying diagrammatic drawing in which.

DESCRIPTION OF PREFERRED EMBODIMENT

Figure 1:
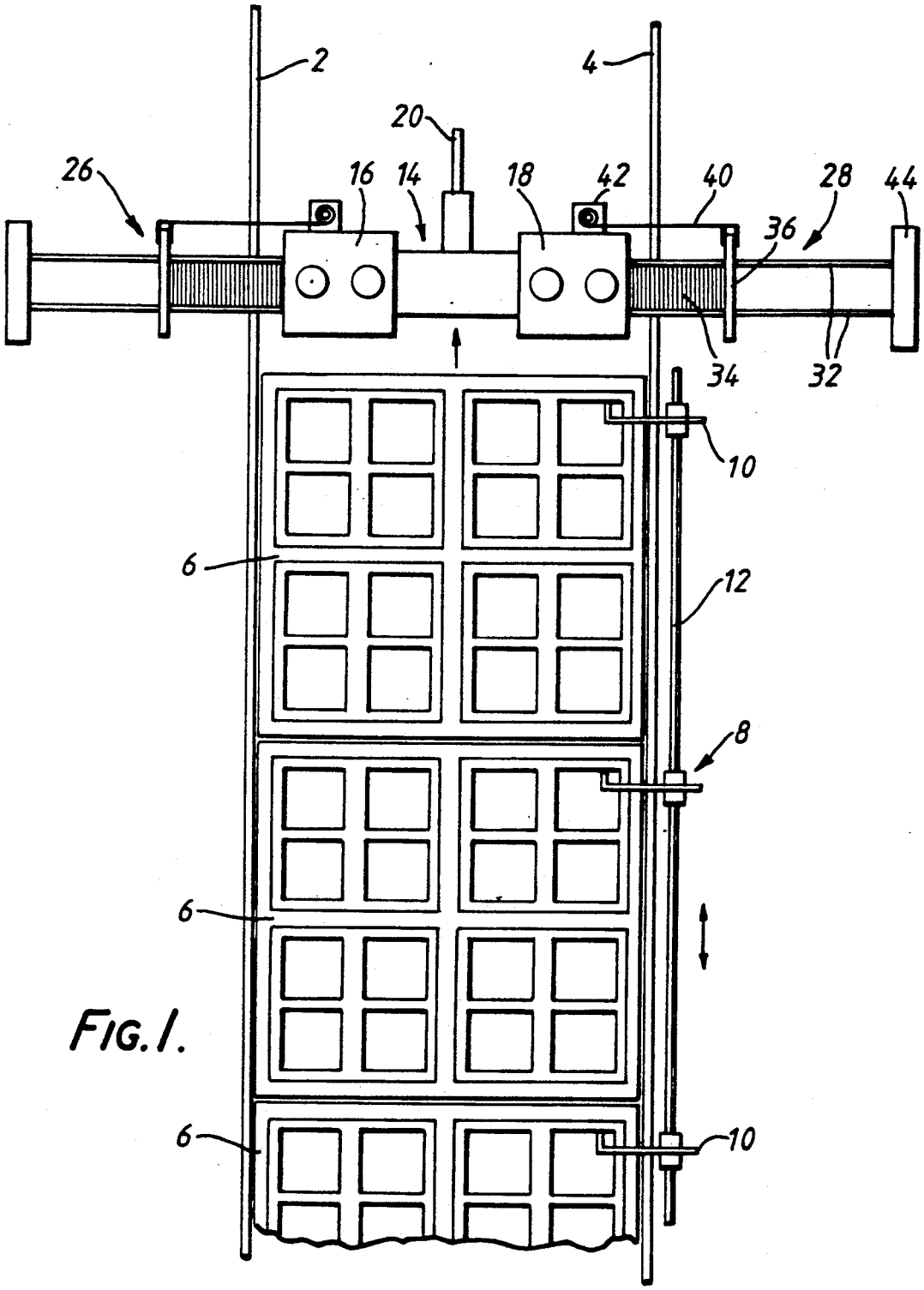
FIG. 1 is a plan view of a seed tray tagging station incorporating two label tagging apparatuses.

The seed tray tagging station shown in FIG. 1 is arranged to feed seed trays in succession past two tagging apparatuses which are operated to apply tags at regular intervals to the passing seed trays.

A pair of guide rails 2 and 4 define a seed tray guide path through the tagging station.

A succession of seed trays 6 are fed along the guide path. Each seed tray 6 comprises sixteen compartments arranged in row and column of 4. In addition the trays are arranged in four groups with the spacing between the groups being slightly greater than the spacing between the compartments in each group.

The trays 6 are driven along the path by a drive mechanism 8 located along one side of the guide path. The guide mechanism comprises an elongate rod 12 slidably supported (by means not shown) for movement in a direction parallel to the guide path.

A pneumatic drive mechanism (not shown) is coupled to the rod 12 and when activated causes the drive rod to reciprocate along its own axis. The stroke of the receprocation is adjusted to correspond to just in excess of the intervals at which tags are to be inserted into the trays 6. The rod 12 carries pivotal fingers 10 which project over the guide rail 4. The fingers 10 are pivotal about the axis of the rod 12 and are constrained for axial movement with the rod 12. The free end of each finger 10 is directed both downwardly and in the downstream direction of the path so as to project into a compartment of a seed tray underlying the finger 10. In operation when the rod 12 is caused to perform its forward stroke each finger 10 will move forward into engagement with the adjacent wall or partition defining the downstream end of the compartment and thereafter displace the whole tray between the guide rails in the downstream direction.

At the end of the forward stroke and during the return stroke each finger 10 will pivot up and over each trailing wall or partition that is traversed until the end of the stroke. Upon the next forward stroke of the rod 12, each finger 10 will engage the leading wall of the partition or compartment in which it now finds itself and again displace the tray 6 in the downstream direction. It will then be seen that as the rod 8 reciprocates the trays 6 will be stepped along the path in steps corresponding to a multiple of the pitch of the compartments.

A transverse support assembly 14 extends transversely over the seed tray path and supports two automatic tagging machines or appartuses 16 and 18. The assembly also supports a trip finger 20 which extends downwardly into the path of the seed trays to be engaged and raised by the leading edge of any passing seed tray 6. The finger 20 is so positioned that it will ride on longitudinal partition of the seed tray 6 as the seed tray passes below. In this way the finger 20 will be held in the raised position for as long as a seed tray is passing through the station.

Movement of the finger 20 from the lowered to the raised position will trip the two tagging machines into operation (by means not shown).

Each tagging machine 16 and 18 is synchronised for operation with the pneumatic drive for the rod 12. Thus at the end of each forward stroke of the rod 12 and during its return stroke, each tagging machine is triggered to insert a tag into the compartment of the tray lying immediately below.

Each tagging machine 16 and 18 has a respective tag cartridge 26 and 28. The tag cartridge 28 comprises two pairs of rods 30 and 32 (only the upper pair 32 being shown in FIG. 1).

Figure 3:
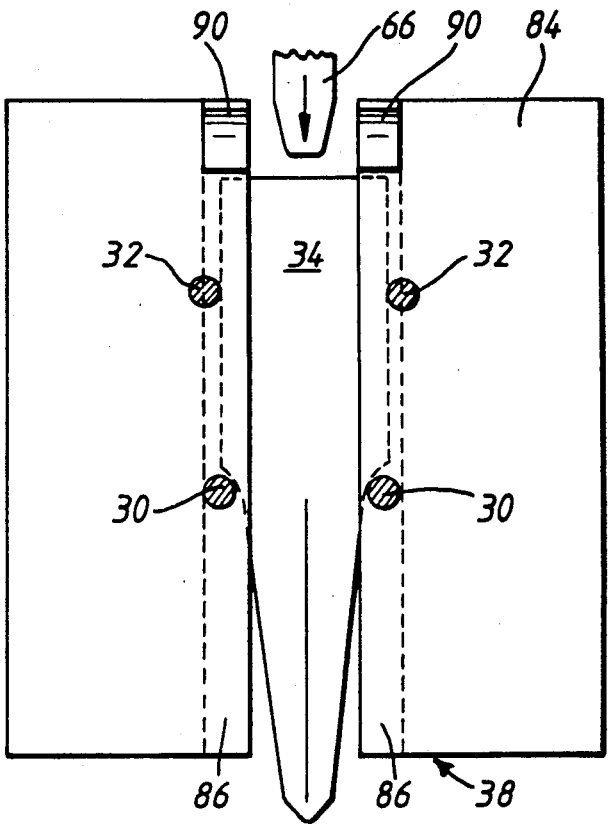
FIG. 3 is an end elevation, to an enlarged scale, of a tag feeding section of the apparatus of FIG. 2.

The rods 30 and 32 as can be more clearly seen in FIG. 3, support a row of tags 34 in a vertical attitude.

Each tag 34 as shown has a rectangular upper portion and a tapered lower portion; there being a curved step between the upper and lower portions. The two lower rods 30 engage the steps on opposite sides of the tag 34 to bear the weight of the tag. The two upper rods 32 engage the upper parallel extremities of the tag 34 to hold the tag 34 in a vertical attitude.

A pusher member 36 is slidably mounted on all four rails 32 and 30 to engage the last tag 34 in the row and to push the row of tags 34 towards a breach or channel defined by a dispensing head 38 of the tagging machine 18.

A spiral or clockwork spring 40 has one end secured to a lug 42 mounted on the tagging machine 18 and its other end secured to the pusher member 36 to bias the pusher member 36 towards the dispensing head 28.

The four rods 30 and 32 are supported at one end by a support block 44 and at the other end by the dispensing head 38.

The tag cartridge 26 is similar to the tag cartridge 28.

Figure 2:
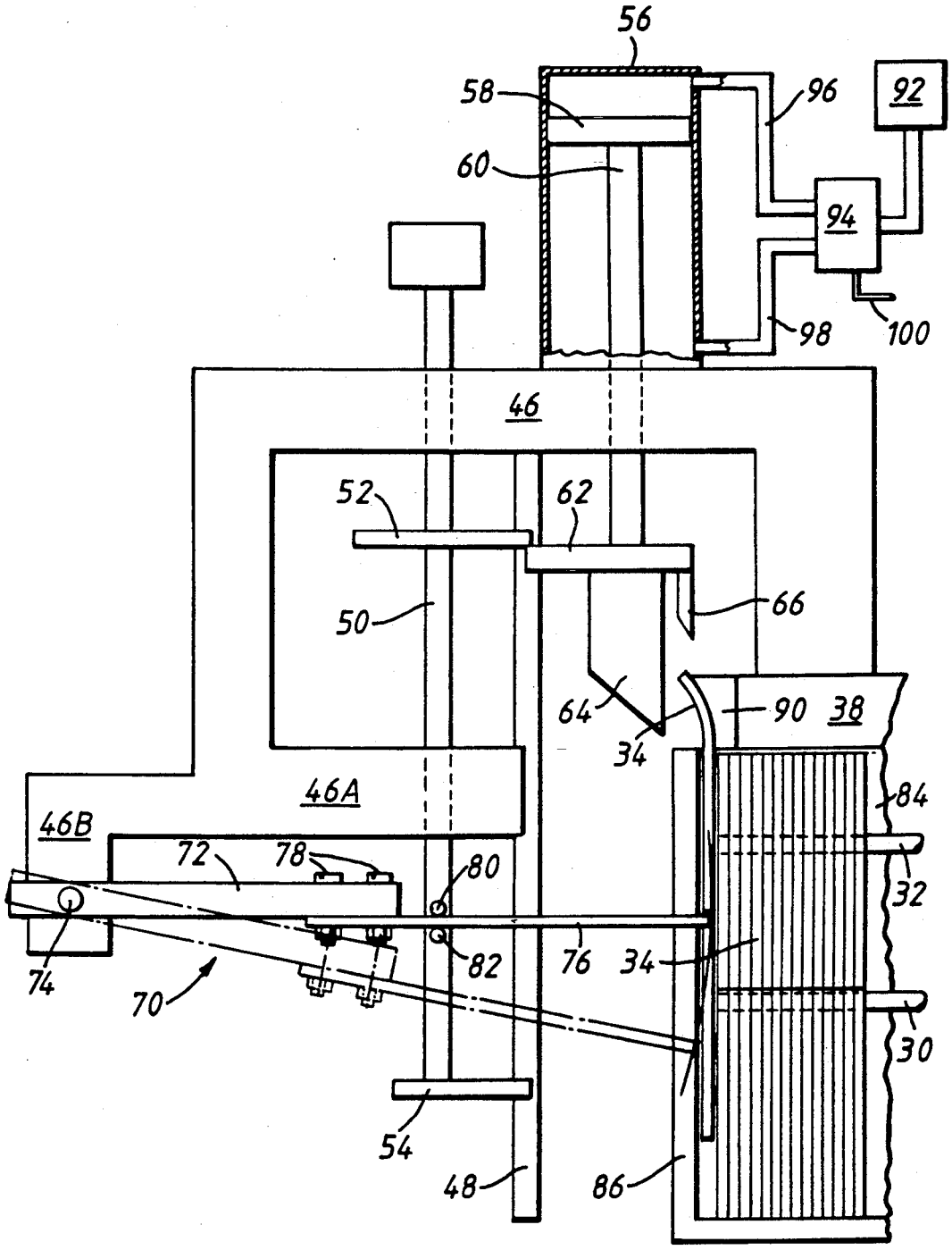
FIG. 2 is a fragmentary front elevation of one of the label tagging apparatuses of FIG. 1.

The tagging machine 18 as more clearly shown in FIG. 2 has a support structure 46 which carries the tag dispensing head 38. A guide rod 48 is supported at its upper end by the structure 46 and is also supported in a central region there of by a projecting portion 46A of the support structure.

The projecting portion 46A extends about the rod by less than 180°, so that at least a portion of the outer surface of the rod remains exposed for guiding purposes.

A trip rod 50, located on one side of the guide rod 48 is slidably supported by both the main part of the support structure 46 and the projecting portion 46A thereof.

The trip rod 50 carries a pair of spaced radially extending trip arms 52 and 54. A distal end of each trip arm has a curved recess which matingly engages the guide rod 48. The trip arms 52 and 54 can slide up and down the guide rod 48 and act to prevent the trip rod 50 from rotating about its own axis.

A cylinder 56 mounted on the upper surface of the support structure 46 has a piston 58 carrying a piston rod 60 which extends downwardly through the support structure to lie on the opposite side of the guide rod 48 to the trip rod 50. The cylinder 56 and piston rod 60 are in fact of greater length but have been shown shortened for convenience. A guide arm 62 supported at the lower end of the piston rod 60 has a part circular recess at its distal end which matingly engages the guide rod 48. The guide arm 62 can thus slide up and down the rod 48 but constrains the piston rod against rotation about is longituidinal axis. The guide arm 62 is located between the two trips arms 52 and 48 and is such that during the upward stroke of the rod 60, the arm 62 will engage the trip arm 52 and displace it upwardly, and during the downward stroke it will engage the other trip arm 54 and displace it downwardly.

The guide arm 62 supports a pair of fingers 64 and 66 for engaging a tag and displacing it into a compartment of a seed tray below.

A tag extraction assembly 70 includes a rod 72 pivotally secured by a pivot 74 to a projection 46B of the support structure 46 for angular movement about a horizontal axis. An elongate laminar extractor member 76 is secured at one end portion to the distal end of the rod 72 by a pair of bolts and nuts 78. The other end portion of the extractor member 76 is bifurcated to provide a passage for the trip rod 50 and the guide rod 48 and to define two extraction fingers 76A which are spaced apart by a distance corresponding to the spacing between the two curved steps in the tag 34. The action of the fingers 76A is to engage the stepped portions and to raise the tag 34 from the dispensing head 38. This will be described in more detail hereinafter.

The trip rod 50 carries a pair of diametrically extending lock pins 80 and 82 located on opposite sides of the extractor member 76 to couple the extractor member 76 to the trip rod for vertical movement.

Figure 4:
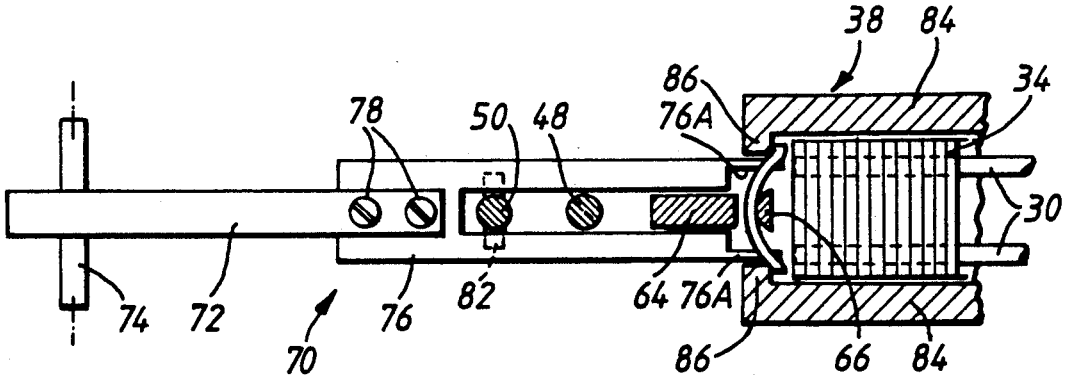
FIG. 4 is a fragmentary plan view, partly in section of the apparatus of FIG. 2.

The dispensing head 38 as more clearly shown in FIG. 4 has a pair of guide walls 84 defining a passage into the head 38 towards the breach channel for the rows of tags 34. Each wall 84 terminates in an abutment 86 defining the breach channel into which the tags 34 are urged. The two abutments are spaced apart to define a gap sufficient to accommodate the pair of extractions fingers 76A. As can be seen in FIG. 4 the fingers 76A penetrate the head so that they terminate just short of the second tag in the row. Thus the fingers underlie only the first tag in the row. As can also be seen the rods 32 and 30 terminate just short of the first tag in the row so that they do not impede the vertical movement of the first tag either up or down.

Mounted on the inner face of each wall 84 at is upper end and above the row of tags 34, is a profiled guide or abutment 90 (see FIG. 3). The lower end of the forward face of each abutment 90 lies horizontally spaced from the abutments 86 by a distance just in excess of the width of one tag to allow the leading tag to pass in the gap between the abutments 86 and 90.

The forward face of each abutment 90 is curved (see FIG. 2) in the forward direction (to the left hand side as viewed in FIG. 2). Thus when the leading tag 34 is forced upwardly along the channel and between the two pairs of abutments 86 and 90 its upper portion will be deflected away from the common plane of contact with its immediately adjacent tag 34 (see FIG. 2).

The two displacement fingers 64 and 66 are so positioned that in the raised position of the piston rod 60 and with the leading tag 34 in the raised position, the fingers 64 and 66 straddle the upper end portion of the leading tag 34.

A pneumatic power source 92 feeds a pneumatic switch 94 which is coupled by respective hoses 96 to 98 to the cylinder on opposite sides of the piston 58.

A central inlet 100 of the switch 94 is coupled to the drive for the rod 12 so that power is switched from one hose 96 to the other 98 at the end of each stroke of the rod 12. In operation it will be assumed that the tagging apparatus as shown in FIG. 2 is a state in which the power source 92 is OFF and the two rods 50 and 60 are in their raised positions.

Now as the first seed tray is fed along the path the trip finger 20 is engaged and raised by the seed tray. This action causes the power source 92 to be turned ON. Initially power is fed by the hose 96 to the upper part of the cylinder 56 and the piston 58 and piston rod 60 are thus moved downwardly. It will be assumed that the extractor member 76 was in the raised position (ie a position in which the fingers 76A lie above the curved stepped portions of the tags) at the time the row of tags 34 were first loaded into the tag cartridge 28. With this configuration the leading tag 34 will abut the ends of the fingers 76A and be held spaced from the abutments 86 by a distance corresponding to the width of one tag 34.

With no tag in the breach position the fingers 64 and 66 in descending with the piston rod 60 will not engage the leading tag. Downward displacement of the trip arm 54 will draw the trip rod 50 down which in turn will cause the tag extraction assembly 70 to pivot in a clock wise sense until it reaches the position shown in broken lines in FIG. 2. In this position the fingers 76A will have disengaged the leading tag 34 and now the leading tag 34 will move into the breach position.

As the guide arm 62 rises with the rod 60 it will engage the other trip arm 52 to raise the rod 50 and in turn to cause the extractor assembly 70 to pivot in the anti clock wise sense. As the two fingers 76A of the extractor member 76 rise they will engage the stepped portions of the leading tag which is now in the breach position and so lift the leading tag upwardly. The upper end of the leading tag is directed away from its adjacent tag into the gap between the two fingers 64 and 66 by the curviture of the abutments 90.

The leading tag is now in the position shown in FIG. 2.

Upon the next downward stroke of the piston rod 60 the two fingers 66 and 64 will engage the leading tag 34 and force it downwardly. This action causes a central portion of the tag to bow outwardly away from the adjacent tag as shown in FIG. 4. The stepped portions of the tag 34 will in turn displace the fingers 76A downwardly and so pivot the extractor assembly 70 in a clock wise sense until the two fingers 76A clear the locus of the path followed by the tag 34. The tag will now continue in downward movement unimpeded until it becomes embedded in the soil in the seed tray compartment directly below.

Because the extractor assembly 70 is now in the lowered position the trip arm 54, will now be in a lower position then it was at the start and so the guide arm 62 will not engage the trip arm 54 as before. The provision of the trip arm is to allow the system to be primed if upon loading a row of tags, the leading tag does not move into the breach position. Upon the return stroke of the piston rod 60 the whole cycle is repeated.

The tags are thus cyclically supplied until the last tray has cleared the trip finger 20. As soon as the trip finger 20 returns to the lowered position the power supply 92 is switched OFF and the tagging operation ceases.

It will be appreciated that the tagging station described can be adapted to provide one row or more than two rows of tags as desired simply by providing only one or more than two tagging machines.

It will also be appreciated that the invention is not limited to automatically providing seed or seeding trays with identification tags but many other forms of tagging are envisaged, for example the tagging of boxes of chocolate in the confectionary industry.

While a presently preferred embodiment of the present invention has been illustrated and described, modifications and variations thereof will be apparent to those skilled in the art given the teachings herein, and it is intended that all such modifications and variations be encompassed within the scope of the appended claims.

I claim:

1. Apparatus for applying label tags, each said tag having a leading end and a stepped portion, said apparatus comprising a dispensing head defining a linear breach channel for receiving the leading tag of a row of tags, a cartridge for housing a row of tags, means coupling the cartridge to the dispensing head to direct the row of tags towards the breach channel, a tag extraction assembly having tag engaging means movable into the channel into engagement with the stepped portion of the leading tag to displace the leading tag along said channel in one direction, a displacement member for receiving the leading tag and operable to displace the tag along the said channel in the opposite direction, and guide means defining a curved path leading away from the linear direction of the channel for guiding the leading end of the leading tag, when displaced by the tag extraction assembly, along the curved path, into engagement with the displacement member.

2. Apparatus according to claim 1 wherein said guide means is so arranged as to inhibit all but said leading tag against movement along the channel.

3. Apparatus according to claim 1 wherein said tag extraction assembly is mounted for pivotal movement and said tag engaging means has an arcuate locus which traverses the axis of the channel.

4. Apparatus according to claim 3 wherein the displacement member has a rectilinear locus.

5. A tagging machine comprising, means defining a rectilinear dispensing channel, means supporting a row of generally parallel extruding tags, means for guiding said row of tags towards said dispensing channel, extraction means constrained for movement along an arcuate locus intersecting said dispensing channel to engage a said tag in said channel and displace it along said channel in one direction, deflection means located at one end of said channel to deflect an end portion of a said tag emerging from said channel in response to displacement by the extraction means, in a direction away from said row of tags.

displacement means for receiving the deflected portion of said tag and displaceable along the channel in the opposite direction to dispense the tag from the other end of the channel and through displacement of the tag to displace the extraction means along its arcuate locus out of the channel.

6. A machine according to claim 5 including coupling means for coupling the displacement means to the extraction means upon the displacement of the displacement means along the channel if the extraction means is initially located in the channel in a position in which it inhibits entry of a said tag into the channel.

7. Apparatus for applying label tags with stepped portions said apparatus comprising a dispensing head defining a dispensing channel along which label tags can be displaced longitudinally, means for feeding a supply of labels into said channel from a first direction substantially at right angles to the longitudinal axis of said channel pivotally supported extraction means having a pair of extraction fingers movable along a locus which intersects the longitudinal axis of said channel and so allows the extraction fingers to engage the stepped portion of a said tag in said channel to displace the tag in second direction along the channel, guide means located at one end of said channel for deflecting the emerging end of the tag displaced by the extraction means in substantially the opposite direction to said first direction, a pair of displacement fingers for receiving the deflected end portion of the tag and displacing the tag along the channel in a third direction opposite to said second direction, displacement of said tag in the opposite direction displacing the extraction fingers out of the path of the channel to allow the tag to emerge unimpeded from said channel, displacement means for displacing said displacement fingers firstly in said third direction and secondly in said second direction, and coupling means for coupling the extraction means to said displacement fingers during the displacement of said displacement fingers in said second direction, to move the extraction fingers back into the channel to effect displacement of a fresh tag in the channel in said second direction.

8. Apparatus according to claim 7 including a support structure, a guide rod supported by the support structure, a trip rod a piston rod, said trip rod and piston rod extending parallel to the guide rod and being supported by said support structure on opposite sides of the guide rod for sliding movement axially of the guide rod, a first trip arm rigid with said trip rod and slidably engaging said guide rod, a displacement arm rigid with said piston rod and slidably engaging said guide rod, said displacement arm carring said displacement fingers; and means coupling the trip rod to the extraction fingers to allow the trip rod to move in a direction tangential to the locus of the extraction fingers, the trip arm and displacement arm being arranged to engage to form said coupling means.

9. A label tag applying station comprising means defining a path for the passage of seed trays there along, means for displacing seed trays along said path in discrete steps, a support structure bridging said path label tag applying apparatus mounted on the support structure for applying label tags to the seed trays as they pass under said support structure, each said tag having a leading end and a stepped portion, said label tag applying apparatus comprising a dispensing head defining a linear breach channel for receiving the leading tag of a row of tags, a cartridge for housing a row of tags, means coupling the cartridge to the dispensing head to direct the row of tags towards the breach channel, a tag extraction assembly having tag engaging means movable into the channel into engagement with the stepped portion of the leading tag to displace the leading tag along said channel in one direction, a displacement member for receiving the leading tag and operable to displace the tag along the said channel in the opposite direction, and guide means defining a curved path leading away from the linear direction of the channel for guiding the leading end of the leading tag when displaced by the tag extraction assembly along the curved path, into engagement with the displacement member.

10. A label tag applying station comprising means defining a path for a passage of seed trays there along, means for displacing seed trays along said path in discrete steps, a support structure bridging said path, a tagging machine mounted on the support structure for applying label tags, each having a leading end and a stepped portion, to the seed trays as they pass under said support structure, said tagging machine comprising means defining a rectilinear dispensing channel, means supporting a row of generally parallel extruding tags, means for guiding said row of tags towards said dispensing channel, extraction means constrained for movement along an arcuate locus intersecting said dispensing channel to engage a said tag in said channel and displace it along said channel in one direction, deflection means located at one end of said channel to deflect an end portion of a said tag emerging from said channel in response to displacement by the extraction means, in a direction away from said row of tags, and displacement means for receiving the deflected portion of said tag and displaceable along the channel in the opposite direction to dispense the tag from the other end of the channel and through displacement of the tag to displace the extraction means along its arcuate locus out of the channel.

* * * * *